US006959713B2

(12) United States Patent
Silva

(10) Patent No.: US 6,959,713 B2
(45) Date of Patent: Nov. 1, 2005

(54) PONYTAIL CONNECTING FASTENER

(76) Inventor: David Alan Silva, 2314 Lafayette St., Santa Clara, CA (US) 95050

( * ) Notice: Subject to any disclaimer, the term of this patent is extended or adjusted under 35 U.S.C. 154(b) by 219 days.

(21) Appl. No.: 10/353,328

(22) Filed: Jan. 28, 2003

(65) Prior Publication Data

US 2004/0154632 A1 Aug. 12, 2004

(51) Int. Cl.[7] ..... A45D 24/00; A45D 8/04

(52) U.S. Cl. ..... 132/200; 132/273

(58) Field of Search ..... 132/275, 273, 132/276–278, 200; D28/11; 2/271; 24/17 B

(56) References Cited

U.S. PATENT DOCUMENTS 2,488,954 A * 11/1949 Winters ..... 132/275
6,123,086 A * 9/2000 Kuglen ..... 132/275
6,601,590 B2 * 8/2003 Neary ..... 132/275

* cited by examiner

*Primary Examiner*—Todd E. Manahan
*Assistant Examiner*—Robyn Doan

(57) ABSTRACT

A hair connecting fastener for securing two sections of hair together. The hair connecting fastener comprises a first elastic looped hair band with an attaching member attached to it and a second elastic looped hair band with an attaching member attached to it. In use the first band is attached to a section of hair; the second band is attached to a separate section of hair; and both attaching members are attached together.

7 Claims, 4 Drawing Sheets

PONYTAIL CONNECTING FASTENER

BACKGROUND OF THE INVENTION

1. Field of the Invention

The present invention and method relates to a hair fastener for connecting two or more hair sections together. More particularly a ponytail connecting fastener comprising two elastic bands with a connecting member attached to each.

2. Description of Prior Art

Many people like to fasten their hair into a ponytail. This is a classic and stylish way to secure the hair however the current invention allows the user to secure two or more ponytails together to create a new and stylish hairstyle.

SUMMARY OF THE PRESENT INVENTION

An object of the present invention is to provide an instrument which is convenient, practical, and inexpensive for use in hair styling.

A further object is to provide an instrument that will keep a plurality of hair sections neatly secured to each other.

A further object is to provide such an instrument that can be used unassisted by the individual styling their hair, eliminating the expense of a professional stylist.

A further object is to provide an instrument that can be reused over and over again.

A further object is to provide an instrument that will quickly hold the user's hair up in a neatly secured style.

According to one aspect of the present invention, there is provided two looped elastic bands with a fastener attached to each.

According to the arrangement described above, each band is secured to a separate hair section. The user then connects the sections together.

Accordingly a preferred embodiment the band is made of elastic and is looped, and each band has one side of a male/female fastener. The male/female fasteners are integrally attached to each band.

In another embodiment the male/female fastener is replaced with hooks attached to each band for hooking the two together.

In another embodiment the two fasteners are "bull-dog" shaped hair-clips attached to each band. In use the ponytails are attached by clamping the two clips to each other or attaching the clips to the hair right next to each other.

In another embodiment the two fasteners are magnets that are attached together, or a piece of metal on one side and a magnet on the other.

In another embodiment there is a hook on one band and a loop on the other. It could be a single hook and loop or many hook and loops (like Velcro). In use the hook is secured to the loop fastener.

The above embodiments can have an additional covering of fabric (scrunchie) covering the bands.

Other objects, features and advantages of the present invention will become apparent from the following description of the preferred embodiments given with reference to the accompanying drawings.

BRIEF DESCRIPTION OF THE DRAWINGS

In the accompanying drawings

PREFERRED EMBODIMENTS

Figure 1:
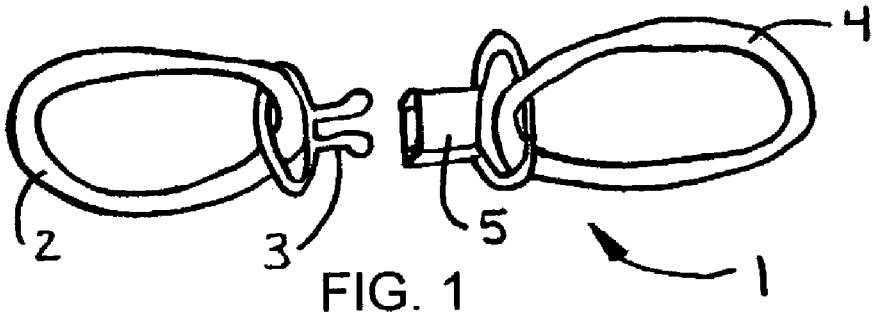
FIG. 1 is a top view showing a ponytail connecting fastener according to the present invention.

Referring to FIG. 1 of the accompanying drawings, there is illustrated a hair connecting fastener, generally designated by reference numeral 1, embodying the present invention. The hair connecting fastener 1 comprises a first band 2 with a male attaching means 3 attached thereto, and a second band 4 with a female attaching means 5 attached thereto. Each band 2 and 4 is a loop and the male and female portions 3 and 5 are integrally attached to each looped band 2 and 4.

Figure 2:
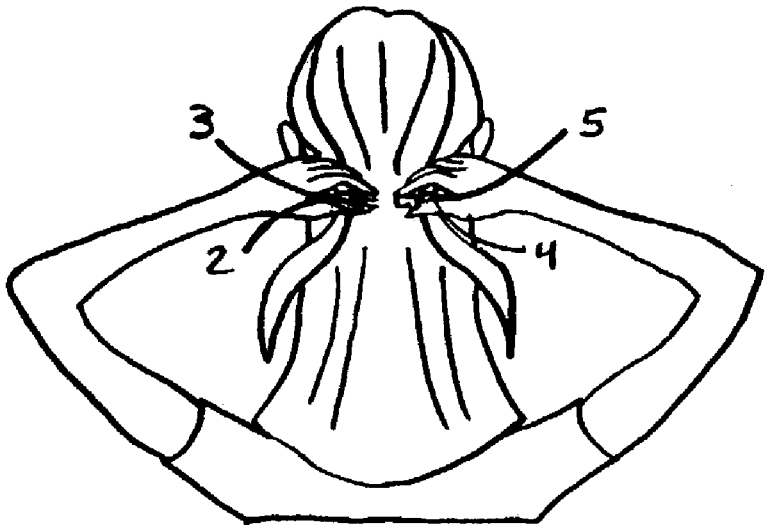
FIG. 2 is a schematic view showing each side of the ponytail connecting fastener secured to a separate section of hair.
Figure 3:
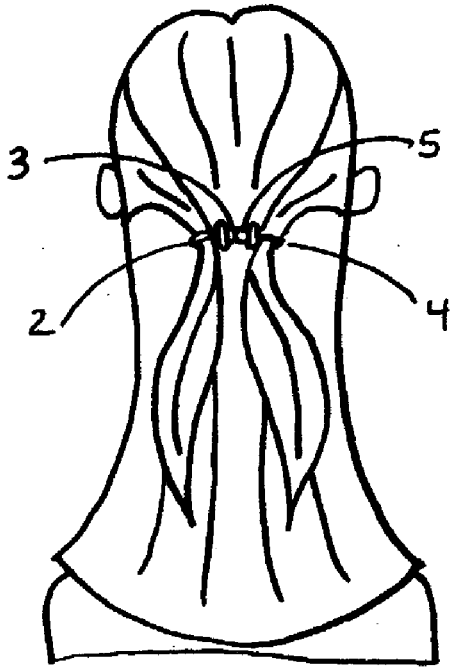
FIG. 3 is a schematic view showing the ponytail connecting fastener connected together.

In use FIG. 2 the first band 2 is attached to a first hair section in a ponytail fashion; the user then attaches the second band 4 to a second section of hair; and the user connects the male and female members to secure the two hair sections together FIG. 3.

Figure 4:
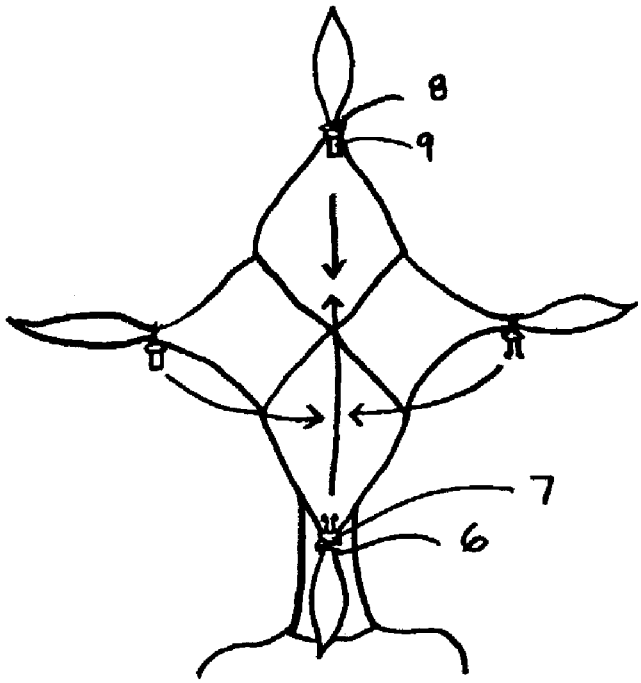
FIG. 4 is a schematic view showing two separate sets of hair secured into ponytails with two sets of the current invention.
Figure 5:
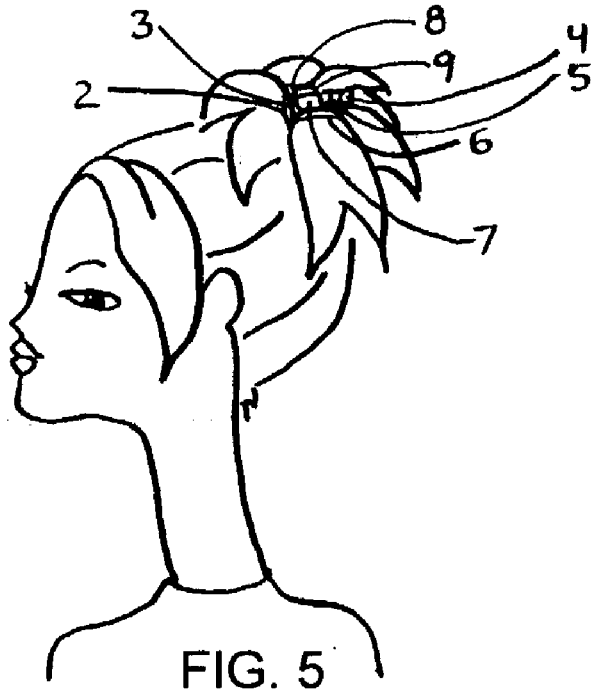
FIG. 5 shows the hairstyle after all four sections are connected.

FIG. 4 shows a third band 6 attached to a third ponytail section with a male attaching means 7 attached thereto, and a fourth band 8 attached to a fourth ponytail section with a female attaching means 9 attached thereto. FIG. 5 shows all four sections attached together.

Figure 6:
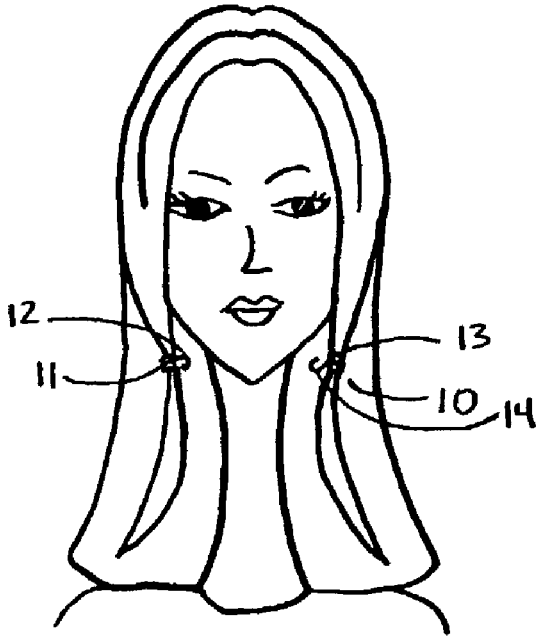
FIG. 6 is another embodiment of the current invention.

Referring to FIG. 6 of the accompanying drawings, there is illustrated another version of the hair connecting fastener, generally designated by reference numeral 10, embodying the present invention. The hair connecting fastener 10 comprises a first band 11 with a hook 12 attached thereto, and a second band 13 with a second hook 14 attached thereto. Each band 11 and 13 is a loop and the hooks are integrally attached to each looped band 11 and 13.

Figure 7:
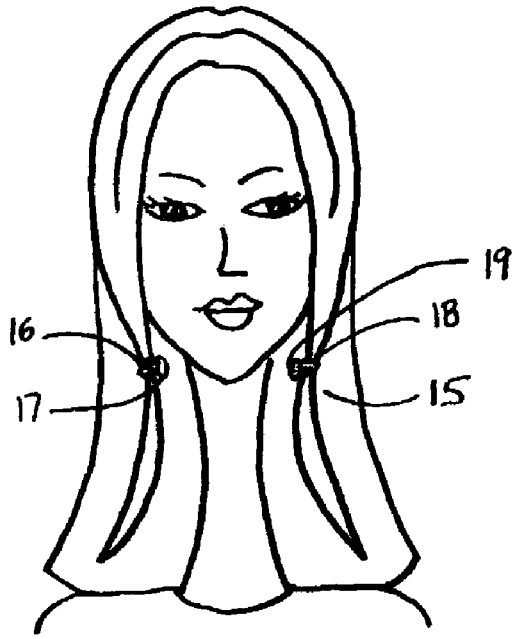
FIG. 7 is another embodiment of the current invention.

Referring to FIG. 7 of the accompanying drawings, there is illustrated a hair connecting fastener, generally designated by reference numeral 15, embodying the present invention. The hair connecting fastener 15 comprises a first band 16 with a magnet 17 attached thereto, and a second band 18 with a second magnet 19 attached thereto. Each band 16 and 18 is a loop and the magnet portions 17 and 19 are integrally attached to each looped band 16 and 18.

Figure 8:
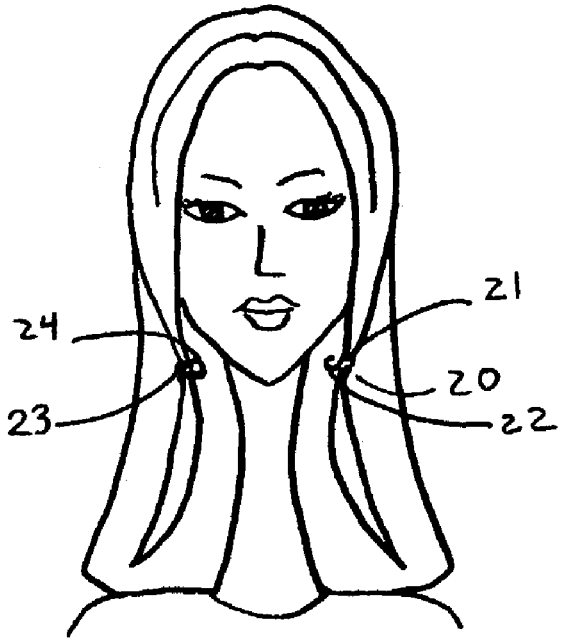
FIG. 8 is another embodiment of the current invention.

Referring to FIG. 8 of the accompanying drawings, there is illustrated a hair connecting fastener, generally designated by reference numeral 20, embodying the present invention. The hair connecting fastener 20 comprises a first band 21 with a hook 22 attached thereto, and a second band 23 with a loop 24 attached thereto. Each band 21 and 23 is a loop and the hook and loop portions 22 and 24 are integrally attached to each looped band 21 and 23.

Figure 9:
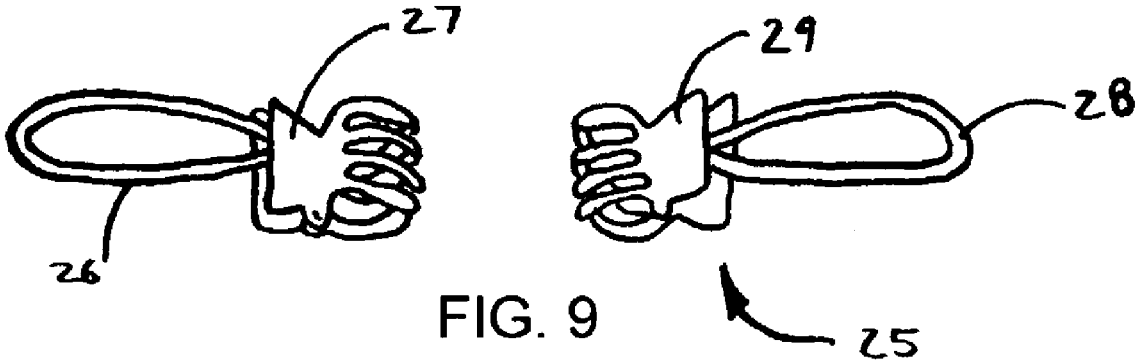
FIG. 9 is another embodiment of the current invention.
Figure 10:
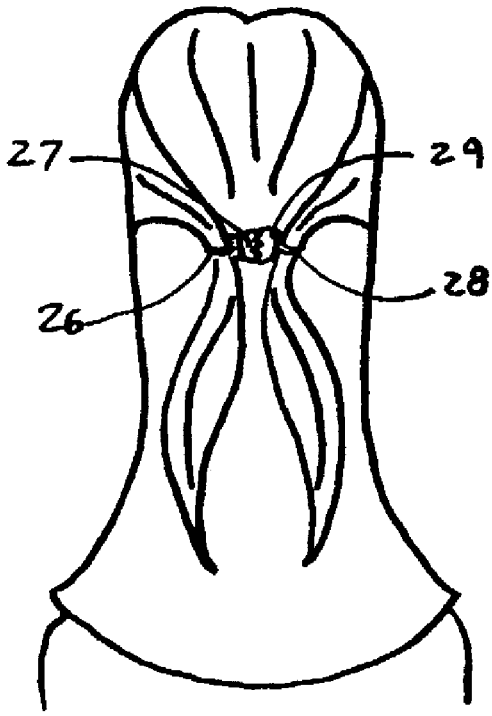
FIG. 10 shows the hairstyle after the sections are connected.

Referring to FIG. 9 of the accompanying drawings, there is illustrated a hair connecting fastener, generally designated by reference numeral 25, embodying the present invention. The hair connecting fastener 25 comprises a first band 26 with a "bull-dog" type hair clip 27 attached thereto, and a second band 28 with a second "bull-dog" type hair clip 29 attached thereto. Each band 26 and 28 is a loop and the hair clip portions 27 and 29 are integrally attached to each looped band 26 and 29. FIG. 10 shows the sections attached together by attaching clip 27 to clip 29.

The present invention being thus described, it is obvious that the same may be varied in many ways. For instance, the hair-bands could be any type of hair-band known in the art, such as a scrunchie (gathered fabric that covers the); anyway to attach the bands to the fasteners will work; and any type of connecter attached to each band that will connect pony-tails together applies. Further, any way to use the present invention obvious in the art should apply. Such variations are not to be regarded as a departure from the spirit and scope of the invention, and all such variations as would be obvious to those skilled in the art are intended to be included within the scope of the claims,

I claim:

1. A method of securing two sections of head hair of a human being together comprising: selecting a hair connecting fastener comprising: a first elastic looped hair band with an attaching means attached thereto; and a second elastic looped hair band with an attaching means attached thereto; said first attaching means and said second attaching means are configured to detachably couple directly together using connecting mechanisms that allow the structure to couple; both said attaching means are detachably connected intermediate said first elastic looped hair band and said second elastic looped hair band; securing said first band to a section of hair with said first attaching means unattached to said second attaching means; securing said second band to a section of hair, with said second attaching means unattached to said first attaching means; and fastening both attaching means directly together intermediate said secured first elastic looped hair band and said secured second elastic looped hair band; whereby said hair sections are neatly secured together and said hair connecting fastener is easily removable and reusable.

2. The method of claim 1 wherein a third looped hair band with an attaching means is attached to a third hair section; and a fourth looped hair band with an attaching means is attached to a fourth hair section; and the third attaching means is attached to said forth attaching means to secure.

3. The method of claim 1 wherein said attaching means on said first band is a male attaching means and said attaching means on said second band is a female attaching means.

4. The method of claim 1 wherein said attaching means on said first band is a hook and said attaching means on said second band is a hook whereby said hooks are hooked together to secure.

5. The method of claim 1 wherein said attaching means on said first band is a magnet and said attaching means on said second band is a magnet whereby said magnets are joined together to secure.

6. The method of claim 1 wherein said attaching means on said first band is at least one hook and said attaching means on said second band is at least one loop whereby said hook and said loop can be hooked together to secure.

7. The method of claim 1 wherein said attaching means on said first band is a hair clip and said attaching means on said second band is a hair clip whereby said hair clips are clipped together to secure.

* * * * *